US009718519B2

(12) United States Patent
Radler

(10) Patent No.: US 9,718,519 B2
(45) Date of Patent: Aug. 1, 2017

(54) HOLDING DEVICE FOR HOLDING A SHIP'S BOAT OR OTHER ADDITIONAL COMPONENT TO BE CARRIED ALONG, AND USE OF SAID DEVICE

(71) Applicant: S4U GmbH, Unterschleissheim (DE)

(72) Inventor: Dieter Radler, Unterschleissheim (DE)

(73) Assignee: S4U GmbH, Unterschleissheim (DE)

( * ) Notice: Subject to any disclaimer, the term of this patent is extended or adjusted under 35 U.S.C. 154(b) by 0 days.

(21) Appl. No.: 15/023,127

(22) PCT Filed: Sep. 17, 2014

(86) PCT No.: PCT/DE2014/200478
§ 371 (c)(1),
(2) Date: Mar. 18, 2016

(87) PCT Pub. No.: WO2015/039663
PCT Pub. Date: Mar. 26, 2015

(65) Prior Publication Data

US 2016/0229495 A1 Aug. 11, 2016

(30) Foreign Application Priority Data

Sep. 19, 2013 (DE) ..... 10 2013 218 783

(51) Int. Cl.
*B63B 23/62* (2006.01)
*B63B 27/36* (2006.01)

(52) U.S. Cl.
CPC ..... *B63B 23/62* (2013.01); *B63B 27/36* (2013.01)

(58) Field of Classification Search
CPC ..... B63B 23/00; B63B 23/02; B63B 23/04; B63B 23/06; B63B 23/62; B63B 23/32
USPC ..... 114/259, 365, 368
See application file for complete search history.

(56) References Cited

U.S. PATENT DOCUMENTS

| | | | | |
|---|---|---|---|---|
| 3,442,241 | A | 5/1969 | Daunis | |
| 5,018,475 | A | 5/1991 | Burke | |
| 5,133,275 | A * | 7/1992 | Maurizio | B63B 23/32 114/259 |
| 2012/0125253 | A1 | 5/2012 | Hauersperger | |

FOREIGN PATENT DOCUMENTS

| | | | |
|---|---|---|---|
| DE | 102012006766 | A1 | 10/2013 |
| EP | 2 172 393 | A1 | 4/2010 |

OTHER PUBLICATIONS

International Search Report of PCT/DE2014/200478, mailed Feb. 13, 2015.

* cited by examiner

*Primary Examiner* — Lars A Olson
(74) *Attorney, Agent, or Firm* — Collard & Roe, P.C.

(57) ABSTRACT

The invention relates to a holding device for fastening, to the stem area of a ship, a ship's boat or an additional component to be detachably carried along, which device comprises a plurality of arms which have a hook-shaped coupling and are rigidly or detachably connected to the ship's boat or additional component, and a plurality of receiving portions which comprise at least one coupling shaft and are mounted on the stem or on an additional part of the ship permanently installed on the stem in such a way that the arms are hooked into the coupling shaft by the hook-shaped coupling and by a rotation of the arm or the receiving portion about the coupling shaft are locked in place when a defined angle of rotation is reached.

10 Claims, 6 Drawing Sheets

HOLDING DEVICE FOR HOLDING A SHIP'S BOAT OR OTHER ADDITIONAL COMPONENT TO BE CARRIED ALONG, AND USE OF SAID DEVICE

CROSS REFERENCE TO RELATED APPLICATIONS

This application is the National Stage of PCT/DE2014/200478 filed on Sep. 17, 2014, which claims priority under 35 U.S.C. §119 of German Application No. 102013218783.1 filed on Sep. 19, 2013, the disclosures of which are incorporated by reference. The international application under PCT article 21(2) was not published in English.

The invention relates to a device and a method for the simple and secure fastening of a device carrier, preferably for a ship's boats, to a sailing yacht or motor yacht and for the safe transport of the devices attached thereto during the journey.

Such device carriers are in particular used for fastening and holding a ship's boats, with or without a motor, to the stern area of a sailing yacht or motor yacht, which are carried along for the safety of the crew and for the safe landing on the shore.

Conventional methods for carrying along a ship's boat are based on the following principles:

1. The ship's boat is on the bow of the ship.
2. The ship's boat is on the cabin roof.
3. The ship's boat is attached to the sailing yacht or motor ship using a rope, preferably to the stern area, or during port manoeuvres also often at the side with a rope to the bow or midship cleat.
4. The ship's boat is carried along suspended on davits.

All of the above options of carrying along a ship's boat have decisive disadvantages.

If the ship's boat is transported on the ship itself (1 and 2), both the skipper and the crew are obstructed in their forward view. Depending on the size of the ship's boat, this visual obstruction is rather irresponsible due to safety reasons, or hinders necessary manoeuvres.

Moreover, the ship's boat occupies valuable space on ships with naturally restricted areas. The ship's boat is usually deposited in the working area of the bow. This involves several risks. On the one hand, due to lacking space, the crew can carry out work necessary in case of problems with the fore sail, gennaker or spinnaker only to a limited extent. On the other hand, the fore sail ropes (sheet) may be trapped in the ship's boat during sailing manoeuvres.

Usually at least two crew members are required to launch or lift the ship's boat in an exhausting and time-consuming activity.

The third solution is to tie up the ship's boat to the stern area of the yacht using a rope. From approx. 20 knots of wind speed (corresponds to a wind force of approximately 4) and according seas, the ship's boat may take off from the water, be tossed through the air and possibly damage major parts of the ship, injure the crew, or the trailing rope may break. In the worst case, the ship's boat is lost.

If the ship's boat is secured to the midship or the bow's clamp, the ship's boat may be drawn under the hull of the ship in case of major waves, and the ship's boat and the hull of the ship may be damaged at the bow thruster or the ship's screw, if any.

The required outboard motor must be temporarily dismounted and separately stored for these three alternatives. Even for the third alternative, exceptions are rather not possible due to safety reasons or environmental reasons.

For the fourth solution, the outboard motor would not have necessarily to be dismounted, but the solution using davits is expensive compared to the other solutions and requires appropriate space on board for the davits so that it is practically only useful for bigger yachts and ships.

None of the yacht manufacturers and shipyards has been dealing with this problem so far although this sometimes brings up safety-relevant problems.

In the German patent application no. 10 2012 006 766 A1, a mechanical holding device which is simplified compared to the above solutions has been described. Its content is completely adopted herein.

The invention is based on the task of developing an improved holding device by means of which a ship's boat or an additional component to be carried along can be carried along at the stern area of a ship in an even safer and simpler way.

The mechanics of the holding device required for fastening the ship's boat or the additional component at the ship to be detachably carried along comprises two main parts, namely:

- a plurality of arms (i.e. one or more, preferably at least two, but also three or more) with a hook-shaped coupling which are rigidly or detachably connected to the ship's boat or additional component
- a plurality of receiving portions (i.e. one or more, preferably at least two, but also three or more) which comprise at least one coupling shaft and are mounted on the stern or an additional part of the ship permanently installed on the stern in such a way that the arms are hooked into the coupling shaft by the hook-shaped coupling, and by a rotation of the arm or the receiving portion about the coupling shaft are locked in place when a defined angle of rotation is reached.

If there are several receiving portions, they are mounted to the ship's boat or additional component to be carried along according to a preferred embodiment at the same distances as the arms in such a way that each arm can be engaged in a corresponding additional component. If there are more receiving portions than arms in the system, they are preferably arranged in such a way that at least two arms can be engaged in two corresponding receiving portions. Not allocated receiving portions may either be used for further additional components or for attaching the ship's boat or additional components to be carried along at different positions.

As an alternative for the above mentioned embodiments it is also possible to hook two or more arms into one receiving portion if it is, for example, designed as an individual rod where several arms can be engaged at the same time. To this end, the receiving portion, for example, may be made of a tube or a rod with a length of 10 to 100 cm, preferably approximately 10 to 20 cm for the coupling of individual arms, and approx. 50 to 100 cm, in particular 60 to 70 cm, respectively, for the coupling of two or more arms in the same rod. This embodiment can be produced more cheaply, be attached to the ship more easily and be used for more purposes than individual receiving portions adjusted especially to the width of the arms, and they have the same functionality. However due to the lacking lateral attachment, the fixation of the ship's boat or the additional components may be a little bit insecure whereas the general arresting is the same.

The general principle of the holding device according to the invention is described in detail hereinafter on the basis of a ship's boat carried along without restricting the holding device to this use. The stern area of the ship's boat is either directly lifted or by means of a rope, and the arms are hooked into the receiving portions at the ship, in particular a motor yacht or sailing yacht (hereinafter also simply referred to as "yacht"). As the description will show, this principle is in particular suited for smaller yachts such as yachts with a length of up to 20 meters.

The receiving portions on the yacht have two major advantages. The construction forms kind of an arrester hook which helps laying the arms onto the receiving portions and hooking them into the coupling shafts without any major effort. Thus the ship's boat is preliminary secured to the yacht.

Using a cable winch mounted in the rear area or to the mast of the receiving ship and at the bow of the ship's boat, the ship's boat is pulled to an almost upright position with the bow first. Thus the ship's boat is connected with its stern area with the stern area of the receiving yacht. The bow point upwards at an angle of 45° to 90°.

When lifting the ship's boat, due to the shape and type of the hook-shaped coupling in the arm, the ship's boat with the mounted arm is at first pushed on the main axis to the end of the hook-shaped coupling. Then the ship's boat is pulled upwards on its bow. In doing so, the bow of the ship's boat and the arm move upwards in a curve on the main axis, and the hook-shaped coupling rotates around the coupling shaft into an arresting position preventing the hook-shaped coupling from slipping out of the coupling shaft. The weight of the ship's boat and the special construction of the hook-shaped coupling of the arms and the receiving portions, respectively, result in a very tight connection of arm and receiving portion in the arresting position. Even at wind speeds of approx. 35 knots, no problems were identified. Even if mechanical load acts on the coupling e.g. due to wind, waves, inclination or other influences, the bow of the ship's boat does not move in its arresting position. Thus it is securely and firmly arrested.

Due to the firm arresting and simple mechanics, it is now also possible to use heavy ship's boats (e.g. over 70 kg) or to leave the motor (e.g. outboard motor) on the ship's boat while the ship's boat is transported in the holding device according to the invention.

The holding device according to the invention allows for the ship's boat to be launched in just a few steps carried out in reverse order. Currently, two crew members and much time and effort is required to this end. However, with the holding device according to the invention, this can be done in a few minutes by one person with almost no effort. The effort needed to this end is significantly less and the procedure can also be easily accomplished by physically weaker crew members.

Transporting the ship's boat in the stern area of the yacht does no longer obstruct the view of the skipper or the crew since it is no longer on the bow or the cabin roof in direct line of sight towards the front.

Since the ship's boat does no longer need to be hauled up onto the deck and no longer be launched from the deck over the railing, there is no more risk of destroying the railing or the ship's boat during the handling of the ship's boat.

The risk of loosing the ship's boat is significantly reduced. It is securely attached and is not displaced by higher wind speeds. Thus, the risk of injury or damage during a storm caused by a ship's boat thrown through the air is also reduced.

The available space on a ship which is restricted anyway, and the working area required for manoeuvres are not further reduced by the ship's boat. Any trapping of the sheet ropes in the ship's boat during a sailing manoeuvre is ruled out.

Due to the easy handling and secure arresting alternatives of the holding device according to the invention as described above, it can, according to another aspect of the invention, also be used for additional applications on ships, in particular on motor yachts and sailing yachts. In this context, the arms can be used for holding device carriers for bathing and fishing platforms, barbecue platforms, bicycle or two-wheeler platforms (e.g. for lightweight mopeds or electric bicycles), solar panels, tables and similar devices. The basic principle is the same as mentioned above for holding a ship's boat at the stern of a yacht. In this context, these holding devices can also be used for holding additional components, for example at the bow area or the lateral area of a ship. The advantage is that the holding device can be used in versatile ways, the additional components can be carried outboard and securely retained. For example, if a platform is used as a barbecue platform, a barbecue (e.g. a typical Weber gas barbecue) can be completely used outboard and stored on board after use. This measure increases the safety while it is being used. Further embodiments according to the invention result from the description of the preferred embodiments of the holding device according to the invention as outlined below.

According to a preferred embodiment of the holding device according to the invention, the receiving portions have a locking device such as a locking shaft or a locking plate in addition to the coupling shaft. The locking device, for example, engages in the hook-shaped coupling and inhibits the linear movement of each arm while in the arresting position, preferably after a rotation of the arm by approximately 25 to 40 degrees from the horizontal, further on preferably by approximately 27 to approximately 35, in particular however from approximately 30 degrees. For example, due to the rotation, the locking device enters the recess of the hook-shaped coupling at the arm to such an extent that it will abut against the nose of the hook-shaped coupling after a linear movement and thus prevent the hook-shaped coupling from slipping out of the coupling shaft. The angle of rotation from which such locking should be effective can be defined by the position of the locking device, for example by a locking shaft preferably applied in parallel to the coupling shaft, or by the specific shape of the locking plate, preferably S-shaped, which winds upwards from the rear part of the receiving portion and is mounted to the coupling shaft. The above mentioned values for the rotation until locking is effective are only preferred values; for other applications such as special additional components or a ship's boats, it is also possible to select higher or lower values.

According to another aspect of the holding device according to the invention, the holding device is equipped in such a way that the ship's boat or additional component is retained in the arresting position during the journey by means of a rope winch mounted at a point away from the attachment point of the arms, preferably at a rotating angle between 30 and 90 degrees relative to the horizontal position of the ship's boat or additional component. In order to prevent the coupling shaft from slipping out accidentally, it is preferred that the rotating angle is slightly larger than the smallest rotating angle suited for securing.

According to another aspect, the holding device according to the invention may have arms at the starboard side and the port side of the transom of the ship's boat which are mounted with the hook-shaped coupling pointing away from the ship's boat. Using two arms and corresponding receiving portions will improve stability. This is useful in particular for heavy and extensively protruding additional components. Any outboard motor being used can be applied between the two arms; it is still fully functional if the arms are rigidly attached to the ship's boat. In order to provide enough space for an outboard motor, the arms are preferably arranged to the left and to the right at a distance of between 25 cm and 50 cm seen from the centre of the ship's boat. This makes a distance of both arms of approximately 50 cm to 100 cm, depending on the width of the ship's boat. Further preferred is a vertical distance which is, for example, standardised to 70 cm to provide for an exchangeable holding system where a several ship's boats or additional components can be used interchangeably with the same system. The exchangeability and a standard of 70 cm ensure that the system can be used with any currently popular ship's boats with transom.

For the attachment to the transom of the ship's boat, an L-shaped construction of the arms is useful wherein the attachment of the smaller leg to the transom is preferably fixed or detachable, and the longer leg has a hook-shaped coupling. Both legs preferably cover an angle of approximately 80 and 90 degrees so that the longer leg approximately horizontally points away from the transom of the ship's boat. For common dinghies, the angle is approximately 83 degrees.

The level at which both arms are mounted is approximately the level of the water surface at a floating ship's boat or slightly above.

Materials for the arms include for example square-type material or rounded square-type material or square-type tubes made of plastic, carbon fibre material, aluminium, stainless steel or steel plates in order to ensure adequate stability. The edges are preferably rounded since this can further increase the stability of the construction. As an alternative, it is also possible to use round or oval tubes or U-shaped or I-shaped carrier elements for the arms. In order to ensure the stability and functionality of the hook-shaped coupling, for example, a square-type tube can be optionally welded to the ends of such an arm.

It is further preferred that the arms have an extendible arm (longer leg) consisting of two shaped tubes which can be put together and fixated with each other, and at the end of which the hook-shaped coupling is arranged. They have a fixation unit at the end of the short leg by means of which they can be attached to the transom of the ship's boat. Using arm elements which can be put together, the claws of the arm can be adjusted to the construction of the ship's boat. Due to the possible sliding and arresting function for example by means of conventional spring locks or press locks, other quick fasteners or permanent arresting options of the long leg of the arm, the distance of the ship's boat can also be adjusted during transport for example to provide for more space at the stern, or if you want to move the yacht's stern closer to the quay.

According to a preferred embodiment of the holding device according to the invention, the receiving portion/s may be made of a U-shaped basic component made of plastic, carbon-fibre composite material, aluminium, stainless steel or steel plate which is rigidly connected or pivoted to the ship. If the basic component of the receiving portion is pivoted, the rotation is used for arresting the hinged arm, as described above. In this context, the basic component of the receiving portion must also be arrested after having been rotated to the arresting position in order to ensure that the coupling of the receiving portion is secured to the arm. However, when the arm is rotated around a fixed receiving portion, the mooring rope at the bow of the ship's boat assumes this safety function.

The U-shaped basic component preferably has at least one coupling shaft and at least one locking shaft or at least one locking plate between the two lateral parts wherein the arm with the hook-shaped coupling is pivoted in the coupling shaft. The arrangement of the coupling shaft and the locking shaft in the receiving portion is adjusted to the shape and cut-out of the hook-shaped coupling part in such a way that, after a rotation of approximately 30 degrees, the locking shaft prevents the hook-shaped coupling part of the arm from slipping out of the coupling shaft of the receiving portion. For example, the locking shaft and the locking plate block the linear movement of the coupling part in the arresting position but allow this movement prior to the rotation (initial state when hooking the arm into the receiving portion).

For the useful arrangement of the holding device, in particular for the transport of the ship's boat or a bathing platform it is preferable that the receiving portion/s are either attached at the outside of the stern or counter-sunk in the stern of the ship because thus they do not obstruct most of the manoeuvres, and thus the risk of injury is reduced. To this end, the receiving portions may either be attached directly to the ship or to an already existing platform in the stern area. If they are directly attached in the stern area or on a platform, they may be cladded with a protection and reinforcement element, e.g. made of wood or plastic, in order to avoid injury or damage. To this end, the U-shaped basic components may be cladded or directly mounted in a countersink at the stern e.g. a stern flap in such a way that only recesses with the coupling shaft and the optional locking shaft are exposed where the arms can be hooked in.

They are manufactured, for example, by companies of the metal, plastic, carbon, fibre composites and wood industries. After their completion, the metal parts are treated in a suited process against environmental influences (in particular seawater), e.g. by anodic treatment. Some elements of the invention may be made of either aluminium, stainless steel, steel, carbon fibre composites, wood or impact-resistant plastic provided that they are seawater-proof (salt-water).

Below, the holding device according to the invention is described on the basis of figures wherein equal reference numerals are used for equal components. The figures are only intended for explanation purposes without restricting the invention to special embodiments. The dimensions are also exemplary illustrations of the general principle of the invention.

Figure 1:
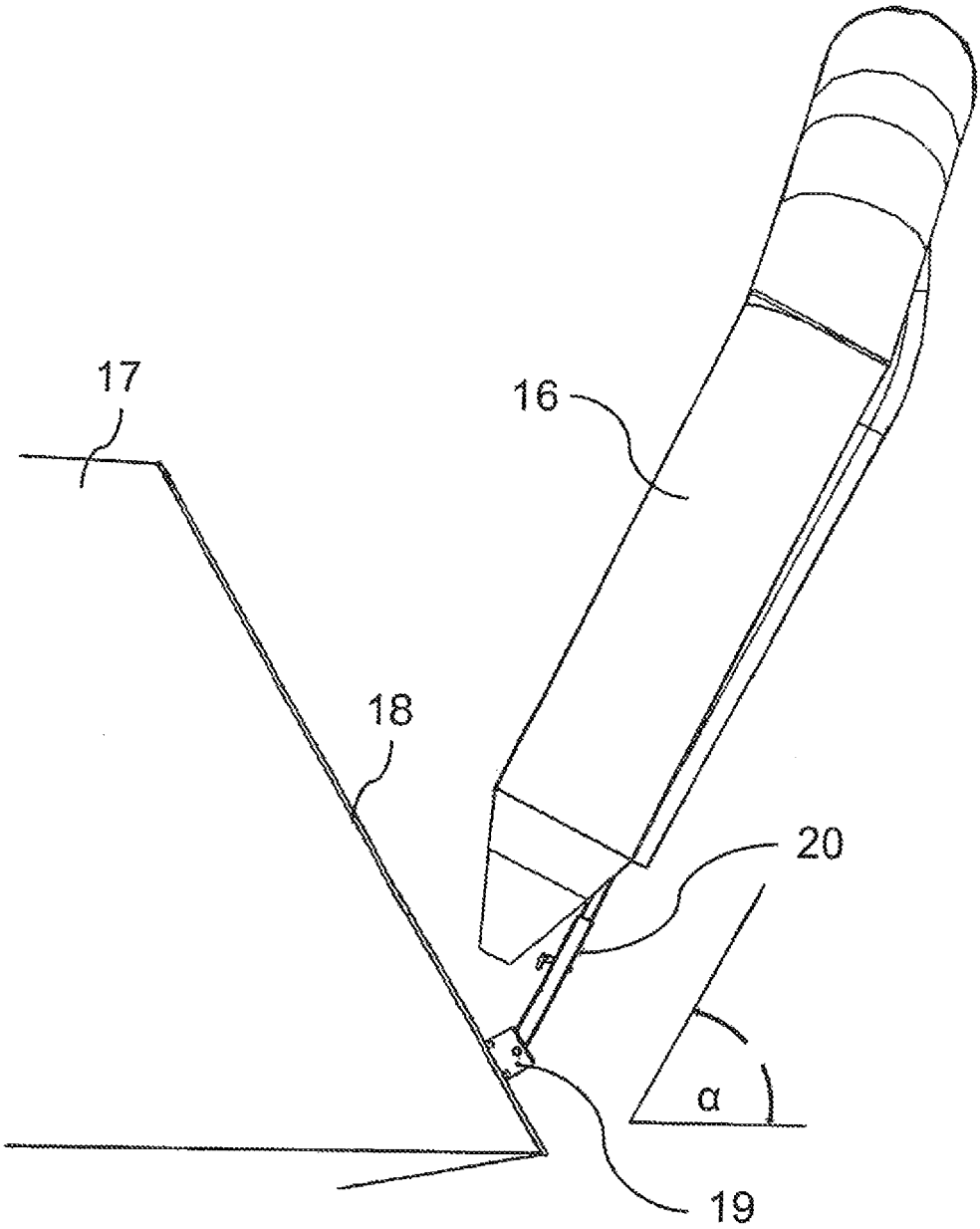
FIG. 1 shows an application option of the holding device according to the invention.

FIG. 1 shows an application option of the holding device according to the invention. At the stern 18 of a ship 17, the receiving portion 19 is firmly attached as the first part of the holding device according to the invention. The receiving portion is detachably connected with the second part of the holding device according to the invention, i.e. the arm 20. The arm 20 is firmly attached to the transom of the ship's boat 16. The ship's boat is lifted by a rope which is not illustrated and retained in this arresting position (angle of rotation $\alpha$ approx. 80 degrees).

Figure 2:
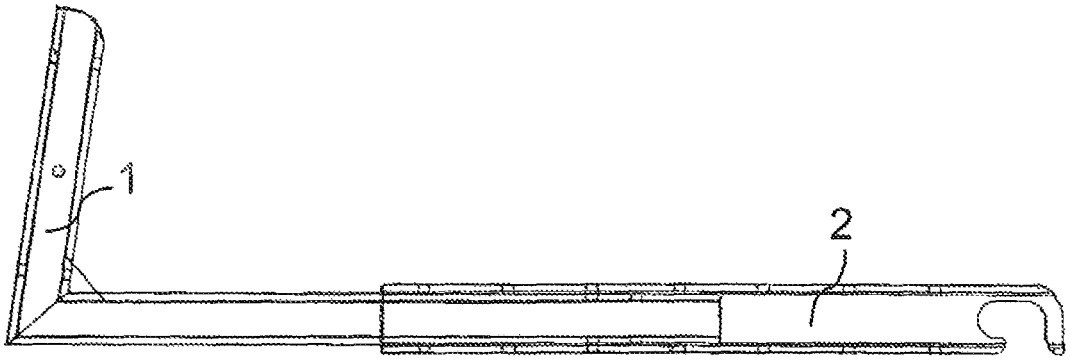
FIG. 2 shows the lateral view of an arm.

The part of the holding device according to the invention to be attached to the ship's boat is referred to as an arm. FIG. 2 shows the lateral view of the arm and how it can be inserted in the holding device according to the invention. The arm is firmly or detachably attached to the stern of the ship's boat—the transom.

The arm of this illustration consists of two parts. One part of the arm is an almost rectangular, L-shaped part consisting of two individual pieces put together. To this end, square (as shown here), round or rectangular tubes are used. This part is referred to as attachment leg 1.

The second part of the arm extends one part of the L-shaped attachment leg 1. This part is also made of square (as shown here), round or rectangular tubes and is used for simple length adjustment. To this end, both parts of the arm are designed in such a way that they can be pushed into one another. The optional adjustment of the moving part of the arm can be used to adjust the distance to the yacht. The extending part of the arm is also referred to as long leg 2 and includes the hook-shaped coupling 3 at its end. Both parts 1 and 2 together form the arm.

Figure 3A:
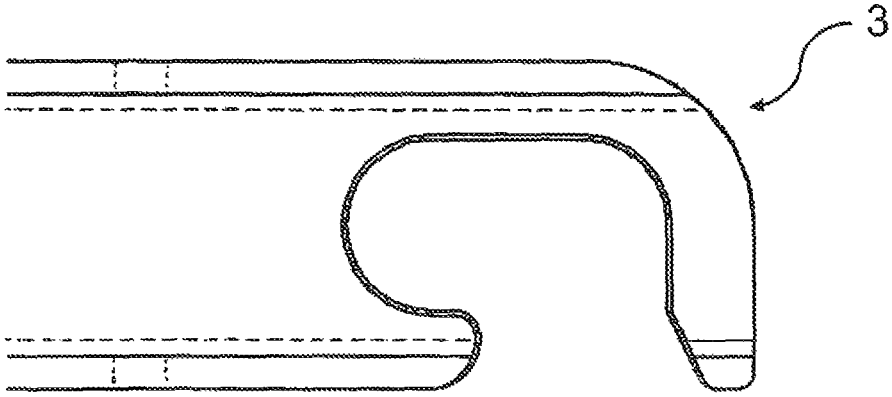
FIG. 3A shows the magnification of the hook-shaped coupling of the arm of FIG. 2.
Figure 3B:
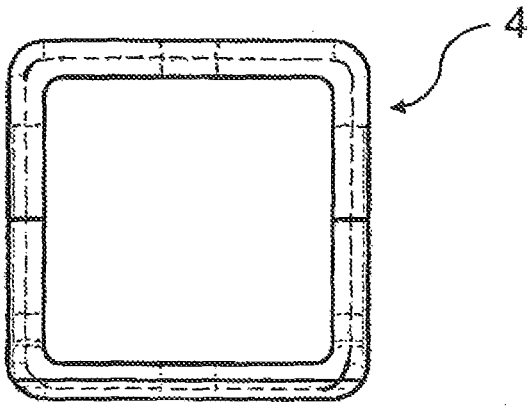
FIG. 3B shows the front view of the arm of FIG. 2.

An enlarged lateral view of the hook-shaped coupling 3 is illustrated in FIG. 3A showing the shape of the cut-out. FIG. 3B shows a front view of the hook-shaped coupling with a clear view on the hollow basic element 4 of the arm.

Figure 4:
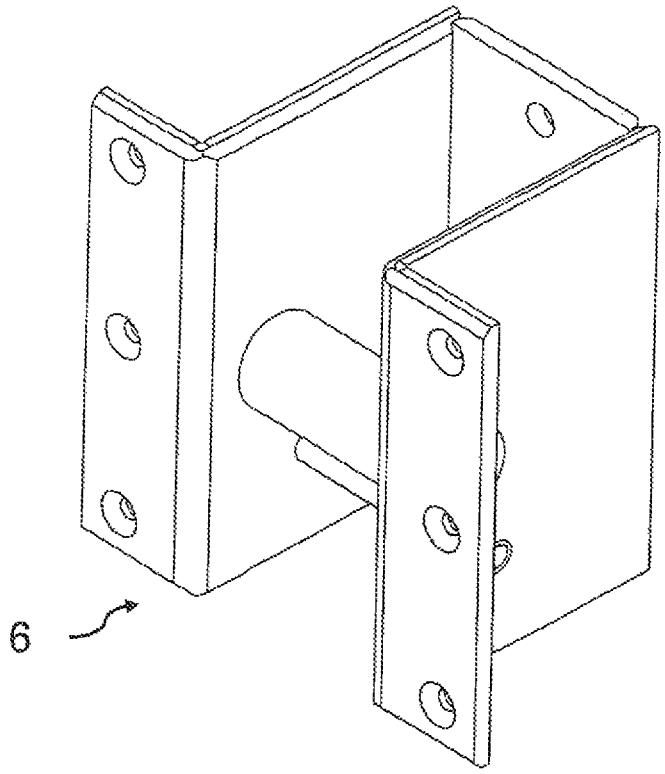
FIG. 4 shows the spatial illustration of a receiving portion.

The receiving portion 6 corresponding to the arm is attached at the stern area of the yacht (see FIG. 4). The hook-shaped coupling 3 of the arm—here a hook-shaped cut-out—is hooked into the coupling shaft 7 of the receiving portion at the yacht.

Figure 5:
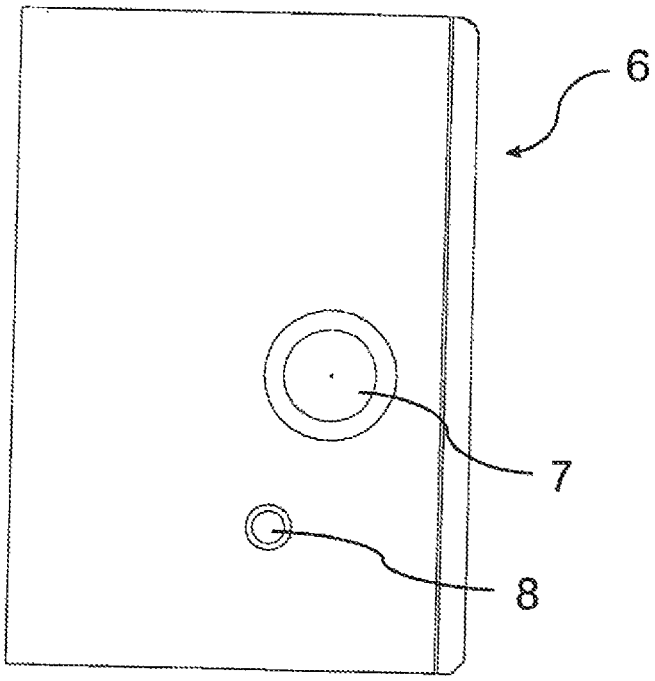
FIG. 5 shows the lateral view of the receiving portion of FIG. 4.

FIG. 4 shows a receiving portion 6 usable according to the invention which has two shafts between the two parallel sides of the U-shaped arrangement—namely a coupling shaft 7 and a locking shaft 8. FIG. 5 shows a lateral view of the shaft the positions. The coupling shaft 7 is used to hook in the hook-shaped coupling at the arm and as a rotating shaft of the arm for arresting. The second shaft is referred to as locking shaft 8 and allows for the firm arresting of the arm after a rotation of approximately 30 degrees.

Both shafts may be different in thickness and very specifically arranged. The coupling shaft 7 must carry the load of the ship's boat and is therefore three to four times as thick as the locking shaft 8. The locking shaft is used for arresting, this means that it inhibits the linear displacement of the arm when it is in the arresting position; it does not carry any load. Therefore, it may be thinner than the coupling shaft. The locking shaft 8 is positioned at a certain distance and angle to the main shaft so that it can be arrested when rotating the hooked-in arm. This will be explained in detail later on.

Figure 6:
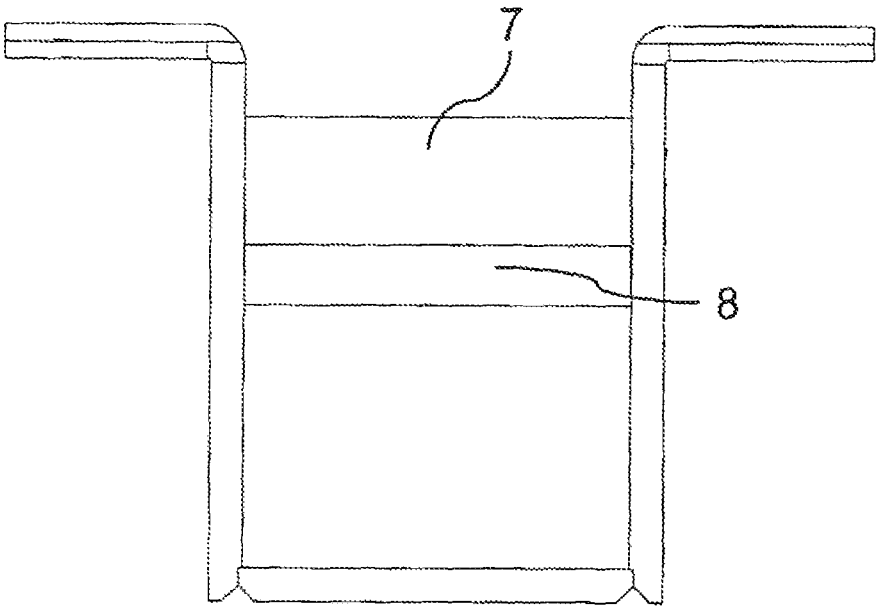
FIG. 6 shows the receiving portion of FIG. 4 from below.
Figure 7:
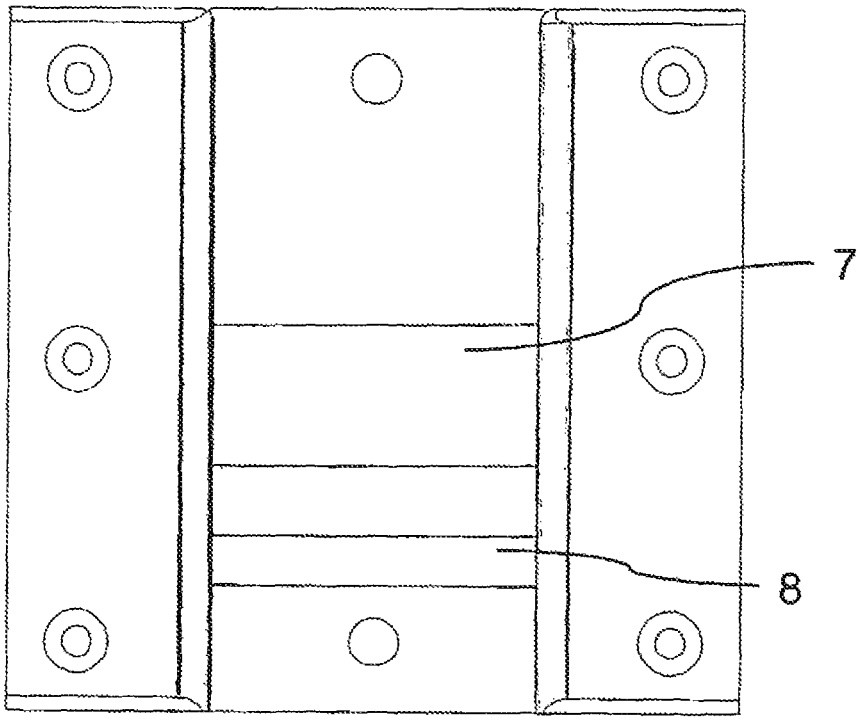
FIG. 7 shows the receiving portion of FIG. 4 from the front.

FIG. 6 shows the receiving portion with both shafts 7 and 8 from below and in FIG. 7 from the front.

Figure 8:
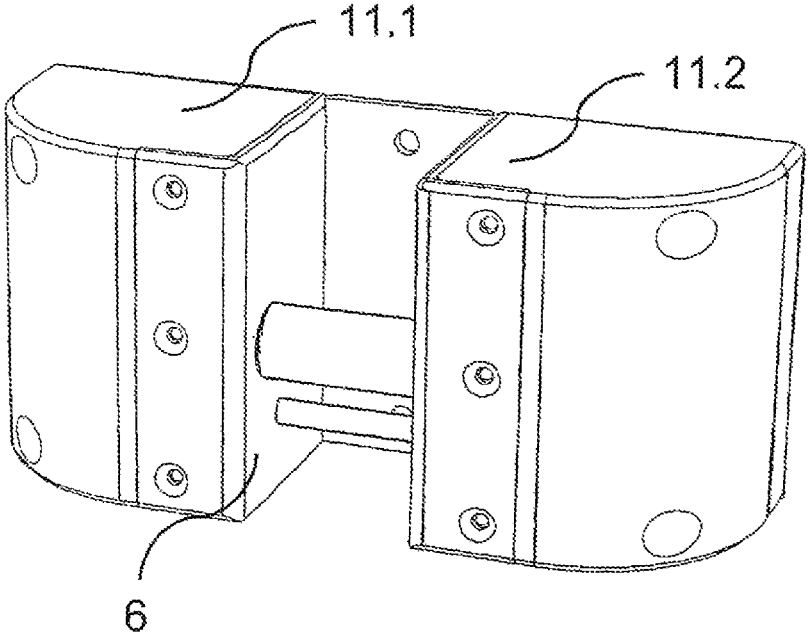
FIG. 8 shows the receiving portion when installed.

FIG. 8 shows the receiving portion when installed. The U-shaped basic component of the receiving portion with both shafts is embedded in a left and a right protection and reinforcement element 11.1 and 11.2 in order to provide for additional stability for the construction and to ensure the safety of the coxswain and the passengers. In this example, both elements 11.1 and 11.2 are made of seawater-proof plastic, but wood, metal or composites would also be suitable for this purpose.

Figure 9:
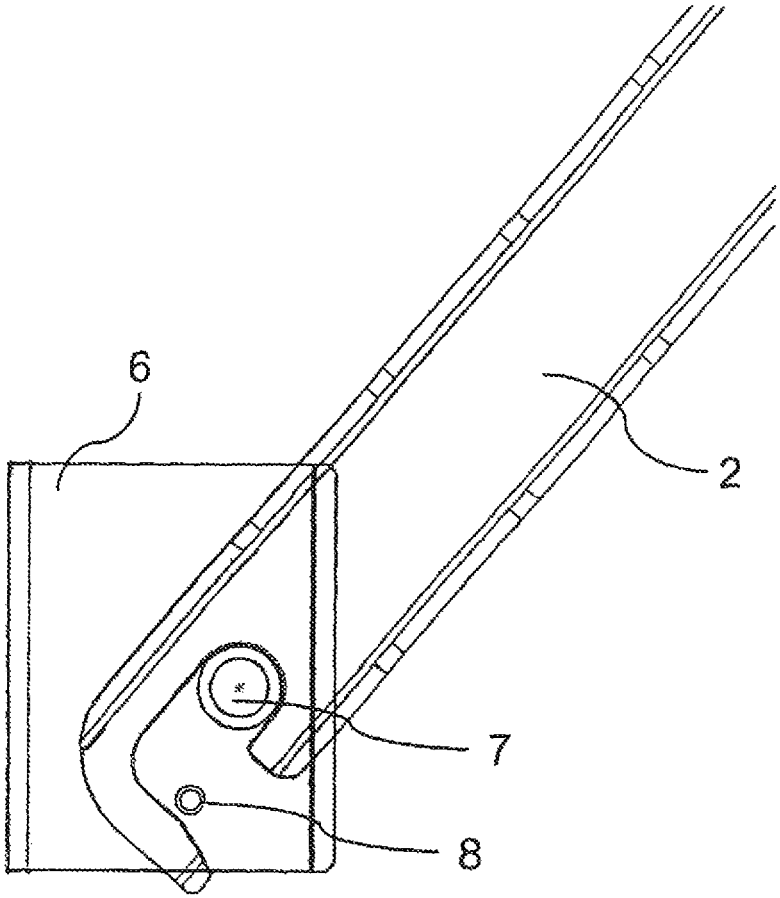
FIG. 9 shows a lateral view of the arm in the receiving portion when being arrested.

FIG. 9 clearly shows the function and the interaction of the individual components of the holding device according to the invention.

The arm (to be more precise the long leg of the arm which is hereinafter referred to as 2) is attached at the stern of the ship's boat (not illustrated). With its end—the hook-shaped coupling 3—it is hooked into the receiving portion 6 which is attached at the stern of the yacht. In doing so, the cut-out of the arm is located, on the coupling shaft 7 of the receiving portion 6 attached at the stern of the yacht (not illustrated). The yacht and the ship's boat are now stern by stern, and the arm 2 of the ship's boat is hooked into the receiving portion 6.

The next step is to try to pull it upwards on the rope at the bow of the ship's boat by pulling at the bow rope of the ship's boat. To this end, the rope may be led from the bow of the ship's boat towards the mast top and from there via a winch in to the cockpit of the ship. There, the rotation position of the ship's boat can be determined with the help of the winch. For yachts without a topping lift, a rope winch tied up at the backstay can be used instead.

When pulling the ship's boat up, the arm 2 on the coupling shaft 7 is at first pushed until the end of the cut-out due to the resulting forces and their directions and due to the arrangement of the shafts (pins) in the receiving portion 6 and due to the shape and type of the cut-out in the arm 2. Since there is no further space for this horizontal linear movement due to the end of the cut-out, the pulling movement at the bow of the dinghy is now turned into a rotating movement on the coupling shaft 7 of the receiving portion. The bow of the ship's boat is pulled upwards. In this process, the arm also moves upwards in a curve on the coupling shaft 7.

The outer nose of the arm 2 is now pressed against the locking shaft 8 in the receiving portion 6. The larger the curved angle relative to the horizontal, the more the nose at the arm is now rotated into the locking shaft of the receiving portion. Once the dinghy has reached a position of approximately 30 degrees relative to the horizontal (approximate position in FIG. 8), the cut-out is pushed onto the locking shaft 8 to an extent that the arm 2 does no longer slide off the coupling shaft 7 of the receiving portion 6. Now the dinghy can no longer be removed from the holder by a linear movement. It still can be pull upwards until an angle of approx. 80 degrees. Then it is completely secured.

The locking shaft 8 is to inhibit the linear movement of the arm 2 hooked into the coupling shaft 7 which can be transferred to the arm particularly in case of wind, waves, inclination of the ship or other impacts on the boat. This linear movement is, however, inhibited by arresting the arm by means of the locking shaft 8 so that safety is significantly increased with simple means compared to safety measures based on the principle of gravity only (e.g. without a second shaft).

Figure 10:
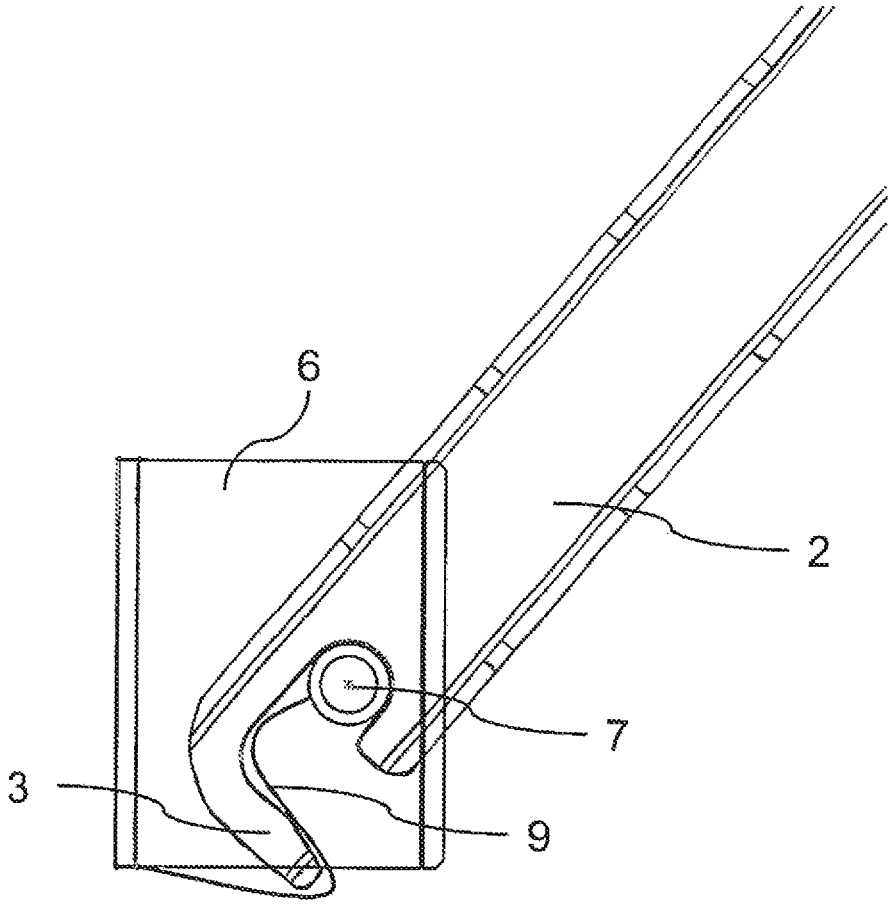
FIG. 10 shows the lateral view of an alternative receiving portion.

As an alternative to the holding device with two shafts—namely a coupling shaft and a locking shaft in the receiving portion—as mentioned above, the holding device according to the invention may have a plate instead of a locking shaft for arresting the arm. FIG. 10 shows such an alternative embodiment for a holding device according to the invention. Except for the alternative solution for the locking device, the structure of the holding device is analogue to the holding device as illustrated in the FIGS. 4 to 9, except for the S-shaped locking plate 9 for arresting the arm 2 in the arresting position (as illustrated). The S-shape of the S-shaped plate is bent upwards by the rear part of the receiving portion 6 and attached to the coupling shaft 7 in such a way that the nose of the hook-shaped coupling 3 is engaged in the arresting position behind the plate and thus prevents the arm from sliding off the coupling shaft due to a linear movement.

The holding device illustrated in the figures can also be used to transport and secure other additional components such as bathing platforms or holders for solar panels etc. with the same principle of arresting being used. The exemplary explanations on the basis of a ship's boat were only used to describe the general principle of the holding device according to the invention in detail, and further embodiments and examples of use for this holding device would be apparent to one skilled in the art. In particular, it cannot only be used at the stern area of a yacht but also in other areas of a yacht. The invention is of significance for all owners of sailing yachts or motor yachts, in particular for yachts with a length, of up to approx. 20 meters. Due to the "stern by stern" arresting option, sailing yachts or motor yachts can be additionally retrofit with the holding device according to the invention at any time.

The invention claimed is:

1. A holding device for fastening, to the stern area of a ship, a ship's boat or an additional component to be detachably carried along, comprising:

a plurality of arms with a hook-shaped coupling which is firmly or detachably connected to the ship's boat or additional component, a plurality of receiving portions which comprise at least one coupling shaft and are mounted on the stern or an additional part of the ship permanently installed on the stern in such a way that said arms are hooked into the coupling shaft by the hook-shaped coupling, wherein said arms are configured to be arrested in the receiving portions by rotation around the coupling shaft when a defined angle of rotation is reached.

2. The holding device according to claim 1, wherein the receiving portions have, in addition to the coupling shaft, a locking device which engages in the hook-shaped coupling thus inhibiting the linear movement of each arm once it is arrested.

3. The holding device according to claim 1, wherein the ship's boat or additional component is retained in the arresting position during a journey via a rope winch mounted at a point away from the attachment point of the arms.

4. The holding device according to claim 1, wherein the arms are mounted at the starboard side and the port side of the transom of the ship's boat with the hook-shaped coupling pointing away from the ship's boat.

5. The holding device according to claim 1, wherein the arms are made of square-type material or rounded square-type material or square-type tubes made of plastic, carbon fiber material, aluminum, stainless steel or steel plates.

6. The holding device according to claim 1, wherein the arms comprise:

an extendible arm comprising two shaped tubes which can be put together and fixated with each other and at the end of which the hook-shaped coupling is arranged and a fixation unit.

7. The holding device according to claim 1, wherein the receiving portions comprise a U-shaped basic component made of plastic, carbon-fiber composite material, aluminum, stainless steel or steel plate which is firmly connected or pivoted to the ship.

8. The holding device according to claim 7, wherein the U-shaped basic component has at least one coupling shaft and at least one locking shaft or at least one locking plate between two lateral parts, and wherein the arm with the hook-shaped coupling is pivoted in the coupling shaft.

9. The holding device according to claim 1, wherein the receiving portions are either attached at the outside of the stern or counter-sunk in the stern of the ship.

10. The holding device as in claim 1, wherein the device is configured for ships, and wherein the arms are used for holding device carriers for bathing platforms, barbecue platforms, solar panels, tables and similar devices.

* * * * *